US010858853B2

(12) United States Patent
van der Meijden et al.

(10) Patent No.: US 10,858,853 B2
(45) Date of Patent: Dec. 8, 2020

(54) AUTONOMOUS ACTIVE WATERLINE SCRUBBING DEVICE PRINCIPALLY FOR SWIMMING POOLS AND SPAS

(71) Applicant: ZODIAC POOL SYSTEMS LLC, Carlsbad, CA (US)

(72) Inventors: Hendrikus Johannes van der Meijden, Midrand (ZA); Michael Edward Moore, Johannesburg (ZA)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 0 days.

(21) Appl. No.: 16/454,482

(22) Filed: Jun. 27, 2019

(65) Prior Publication Data

US 2020/0011079 A1 Jan. 9, 2020

Related U.S. Application Data

(60) Provisional application No. 62/693,586, filed on Jul. 3, 2018, provisional application No. 62/807,967, filed on Feb. 20, 2019.

(51) Int. Cl.

| | |
|---|---|
| ***E04H 4/16*** | (2006.01) |
| ***A47L 11/38*** | (2006.01) |
| ***B08B 1/00*** | (2006.01) |
| ***B08B 1/04*** | (2006.01) |

(52) U.S. Cl.

CPC ..... *E04H 4/1654* (2013.01); *A47L 11/38* (2013.01); *B08B 1/002* (2013.01); *B08B 1/04* (2013.01)

(58) Field of Classification Search

CPC ..... E04H 4/1654; B08B 1/04; B08B 1/002; A47L 11/38

USPC ..... 210/167.1, 167.18, 242.1; 15/1.7

See application file for complete search history.

(56) References Cited

U.S. PATENT DOCUMENTS 2,243,576 A * 5/1941 Otto ..... E04H 4/1609 15/160
4,429,429 A 2/1984 Altschul
4,686,728 A * 8/1987 Rawlins ..... E04H 4/1645 15/1.7

(Continued)

FOREIGN PATENT DOCUMENTS

EP 3293324 3/2018

OTHER PUBLICATIONS

International Application No. PCT/US2019/039429, International Search Report and Written Opinion dated Dec. 20, 2019, 16 pages.

(Continued)

*Primary Examiner* — Fred Prince

(74) *Attorney, Agent, or Firm* — Kilpatrick Townsend & Stockton LLP; Dean W. Russell

(57) ABSTRACT

Buoyant, autonomous devices for actively scrubbing upstanding walls of swimming pools and spas at and nearby their waterlines are detailed. The devices may be configured to float on and travel along a surface of water of a pool and include at least one brush or scrubber adapted to contact pool walls. An electric motor may cause the scrubber to rotate about a shaft or axle, with frictional contact between the scrubber and the wall dislodging dirt and debris therefrom. In particular, if a scrubber is conically shaped and angled relative to the vertical direction, its rotating blades may lift water from the pool to hydrate dried debris stuck to the wall, thereby facilitating dislodging of the debris.

19 Claims, 14 Drawing Sheets

(56) References Cited

U.S. PATENT DOCUMENTS

| | | | | |
|---|---|---|---|---|
| 5,074,004 | A * | 12/1991 | Patton | A47L 11/185 15/1.7 |
| 5,106,492 | A | 4/1992 | Distinti et al. | |
| 5,337,434 | A * | 8/1994 | Erlich | E04H 4/1654 15/1.7 |
| 7,101,475 | B1 | 9/2006 | Maaske et al. | |
| 7,452,461 | B2 | 11/2008 | Riley | |
| 2007/0151914 | A1 | 7/2007 | Riley | |
| 2014/0165307 | A1* | 6/2014 | Hui | E04H 4/1654 15/1.7 |
| 2016/0060887 | A1* | 3/2016 | Tryber | E04H 4/1654 15/1.7 |
| 2016/0145884 | A1* | 5/2016 | Erlich | E04H 4/1636 15/1.7 |
| 2017/0356211 | A1 | 12/2017 | Rejniak et al. | |

OTHER PUBLICATIONS

PCT/US2019/039429, "Invitation to Pay Additional Fees and, Where Applicable, Protest Fee", Oct. 23, 2019, 9 pages.

* cited by examiner

AUTONOMOUS ACTIVE WATERLINE SCRUBBING DEVICE PRINCIPALLY FOR SWIMMING POOLS AND SPAS

CROSS-REFERENCE TO RELATED APPLICATIONS

This application claims the benefit of and priority to (1) U.S. Provisional Patent Application Ser. No. 62/693,586, filed Jul. 3, 2018, and having the same title as appears above, and to (2) U.S. Provisional Patent Application Ser. No. 62/807,967, filed Feb. 20, 2019, and also having the same title as appears above, the entire contents of both of which applications are hereby incorporated herein by this reference.

FIELD OF THE INVENTION

This invention relates to devices for cleaning fluid-containing vessels such as swimming pools and spas and more particularly, although not necessarily exclusively, to autonomous devices for actively scrubbing upstanding walls of pools at and nearby the waterlines of the pools.

BACKGROUND OF THE INVENTION

Generally, a vessel such as a swimming pool includes a bottom surface or floor and upstanding walls, hence forming an open-topped container (which may, if desired, be covered at times when not in use). This container may be filled with water to a depth slightly less that the height of the upstanding walls. The region at which the top-most water contacts the upstanding walls of the pool is typically referred to as the "waterline" of the pool. FIG. 1 of U.S. Pat. No. 4,429,429 of Altschul illustrates such a waterline (84) of a pool, noting that areas of pool sidewalls immediately above the waterline may be among the "most soiled" portions of the upstanding walls. See Altschul, col. 6, 11. 7-13.

Accordingly, described in the Altschul patent is "a device for cleaning the sidewalls of a swimming pool in the waterline region, within a few inches above and below the waterline." See id., col. 1, 11. 8-10. The device connects, via a hose, to an outlet fitting of the pool so as to receive for motive purposes water pressurized by a pump of the water-circulation system of the pool. See id., col. 4, 11. 20-24; col. 5, 11. 43-63. Flexible bristles are attached to a leading portion of the device so as to contact a sidewall as the device travels by exhausting the pressurized water through multiple propulsion jets. See id., col. 3, 11. 21-45. These bristles are, however, passive, moving only as a result of movement of the device itself. Additionally, the device lacks any sort of active steering mechanism, instead merely following the shape of the sidewalls of the pool. See id., col. 6, 11. 54-68.

Another type of pool cleaning device in the form of a solar-powered skimmer is detailed in U.S. Pat. No. 5,106,492 to Distinti, et al. The skimmer of the Distinti patent floats on the water surface of a pool, aiming to capture debris present on that surface. See Distinti, col. 2, 11. 32-47. The skimmer intentionally avoids contact of its housing with any wall of a pool, however, employing a deflection assembly with a curved arm "to guide the skimmer away from the wall." See id., col. 3, 11. 3-19. A similar device illustrated in U.S. Patent Application Publication No. 2007/0151914 of Riley likewise is configured to turn when engaging an edge of a pool, see Riley, p. 2, ¶ 0018, as is the skimmer of U.S. Pat. No. 7,101,475 to Maaske, et al. See Maaske, col. 28, 11. 60-67.

Absent from these patents and application is any disclosure of a surface-floating cleaner with any driven, or otherwise active, wall-scrubbing capability at and near the waterline of a pool. Omitted as well from these documents is any suggestion of a surface-floating device that not only actively scrubs pool walls at and near the waterline, but also skims debris from the water away from the pool walls. Hence, a cleaning apparatus capable of performing these functions could be valuable.

SUMMARY OF THE INVENTION

The present invention seeks to supply such valuable devices as well as methods of utilizing them. At least some versions of the invention provide devices configured to float on and travel along a surface of water of a pool. The devices may include one or more brushes or scrubbers adapted to contact pool walls at and near the waterline of the pool. At least one electric motor may cause the scrubbers to rotate about at least one shaft or axle generally perpendicular to a plane defined by the water surface, with frictional contact between the scrubbers and the pool wall dislodging dirt and debris from the wall. In other versions of the invention, the shaft or axle may be angled other than perpendicular to the plane defined by the water surface.

This motor, further, may be bidirectional, hence permitting the scrubbers to rotate either clockwise or counterclockwise about the shaft. Because at least a portion of the scrubbers will be below the waterline, that portion may function like a vertically-oriented paddlewheel or rudder for purposes of steering the scrubbing device. Alternatively, scrubbers may be generally conical in shape and oriented other than vertically for purposes of steering. Rotation of scrubbers in one direction (e.g. clockwise) will tend to turn the device in one direction (e.g. right), whereas rotation in the other direction (e.g. counterclockwise) will tend to turn the device in the opposite direction (e.g. left).

Presently preferred is that at least one scrubber be centrally located at the front of the body of the device. Also presently preferred is that the centrally-located scrubber be equidistant (or generally so) from two filtration inlets of the device. Consequently, as the device approaches a pool wall at either an acute or an oblique angle, one of the filtration inlets will be closer to the wall than the other. As the scrubber rotates, the scrubber and closer inlet will begin to travel generally linearly along the wall, hence effecting scrubbing along its length with much of the scrubbed debris entering the closer inlet before the debris can diffuse significantly throughout the pool.

It may be possible for the scrubbing device of the invention to approach a pool wall at exactly a right angle. In practice the rotation of the scrubber causes the angle of contact to not be (or not remain) exactly ninety degrees, however, hence resulting in the device beginning to travel generally linearly along the wall in one direction or another.

Because devices of the present invention often will be outdoors floating in swimming pools, they may be exposed to solar radiation. Solar panels included with the devices may convert the solar radiation to electrical energy to power the scrubbers. The electrical energy also may power an impeller or other propulsion equipment of the scrubbing device. Such powering may be direct, or it may be indirect with, for example, the solar panels being used to charge and recharge an on-board battery. Although not presently preferred (because of the need for an electrical cord or hose), the scrubbing device alternatively or additionally could be powered by a remote source of electricity or by pressurized or depressurized water flow.

Any suitable filtration means may be employed in connection with the present invention. One possible such means may include a debris tray accessible from a top of the device. Weirs also may, if desired, be present at the filtration inlets.

Additional optional features of the invention may include a handle to facilitate extracting the device from the water of a pool. In some embodiments, the handle is positioned at the top of the device. The handle, further, may be centrally located between lateral sides of the device but located closer to the front of the device than the rear. Grasping the handle from above (as would someone squatting or kneeling on a deck surrounding the pool) and extracting the device from the pool likely would result in the device assuming an almost-vertical orientation with the front up and rear down, causing water within the device to exit the rear of the device while preventing debris from escaping the filtration means through the front weirs. Yet further optional features include, for example, a sensor for determining when the device has been extracted from water of the pool and a mechanism to splash, mist, spray, or otherwise force water against the sidewalls to facilitate their scrubbing. Other sensors, components, or equipment also may be added as appropriate or desired.

It thus is an optional, non-exclusive object of the present invention to provide a surface-floating device for actively scrubbing vessel walls in the vicinity of the waterline of the vessel.

It is another optional, non-exclusive object of the present invention to provide a device having a scrubber configured to rotate either about a generally vertical axis or about an axis angled other than perpendicular to the water surface.

It is also an optional, non-exclusive object of the present invention to provide a device having both a motorized scrubber and motorized propulsion components.

It is a further optional, non-exclusive object of the present invention to provide a device functioning as a combined scrubber and skimmer in order to clean both walls and water surfaces of pools.

It is, moreover, an optional, non-exclusive object of the present invention to provide a device in which a rotating scrubber also acts as a rudder or similar steering mechanism.

It is an additional optional, non-exclusive object of the present invention to provide a device capable of utilizing various power sources, including various sensors and components, and providing easy extraction from a pool and access to filtration equipment.

It is yet another optional, non-exclusive object of the present invention to provide a device having a scrubber that is generally conical in shape.

Other objects, features, and advantages of the present invention will be apparent to persons skilled in the relevant art with reference to the remaining text and drawings of this application.

DETAILED DESCRIPTION

Figure 1:
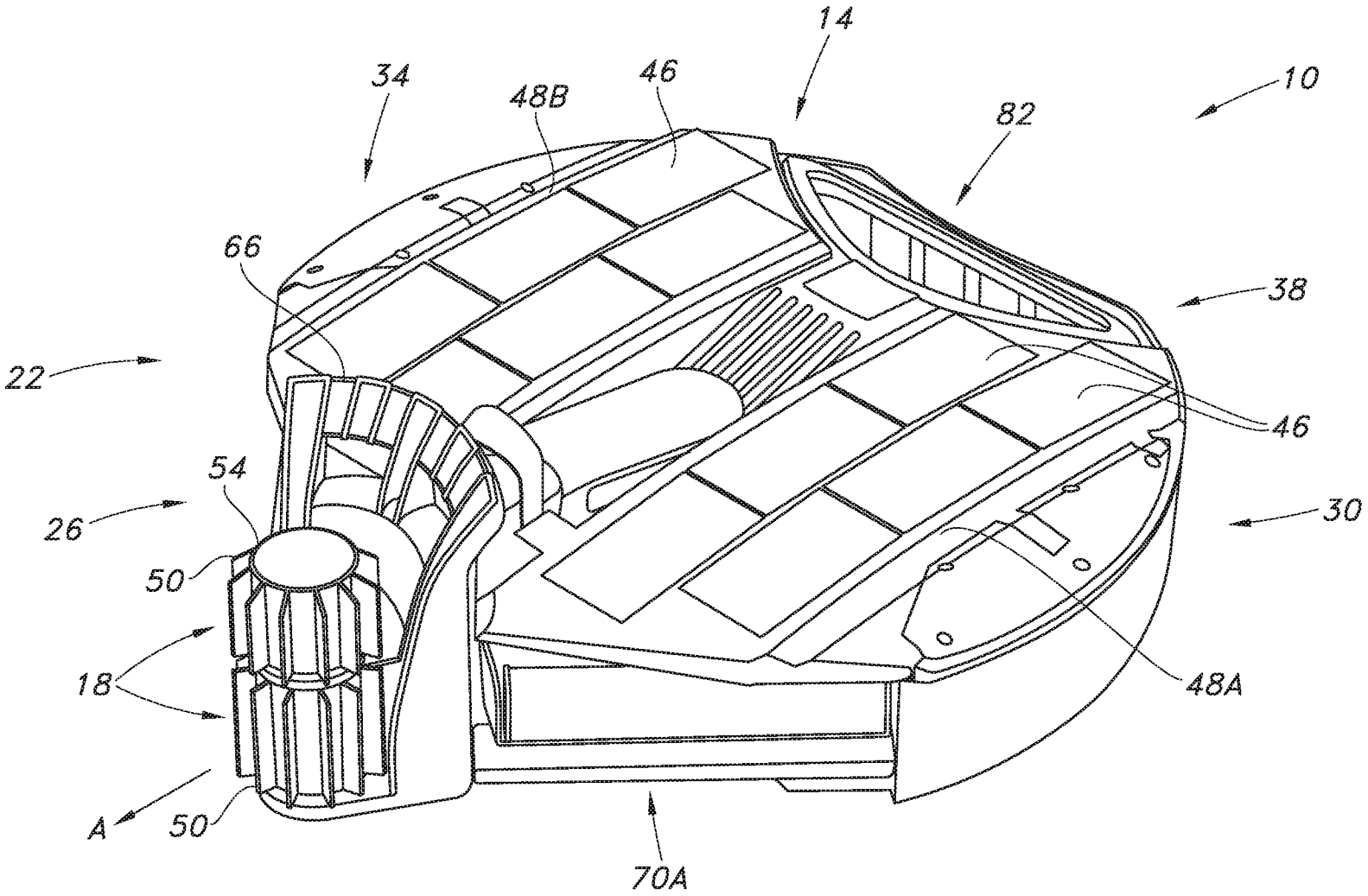
FIG. 1 is a perspective view of a device of the present invention.
Figure 2:
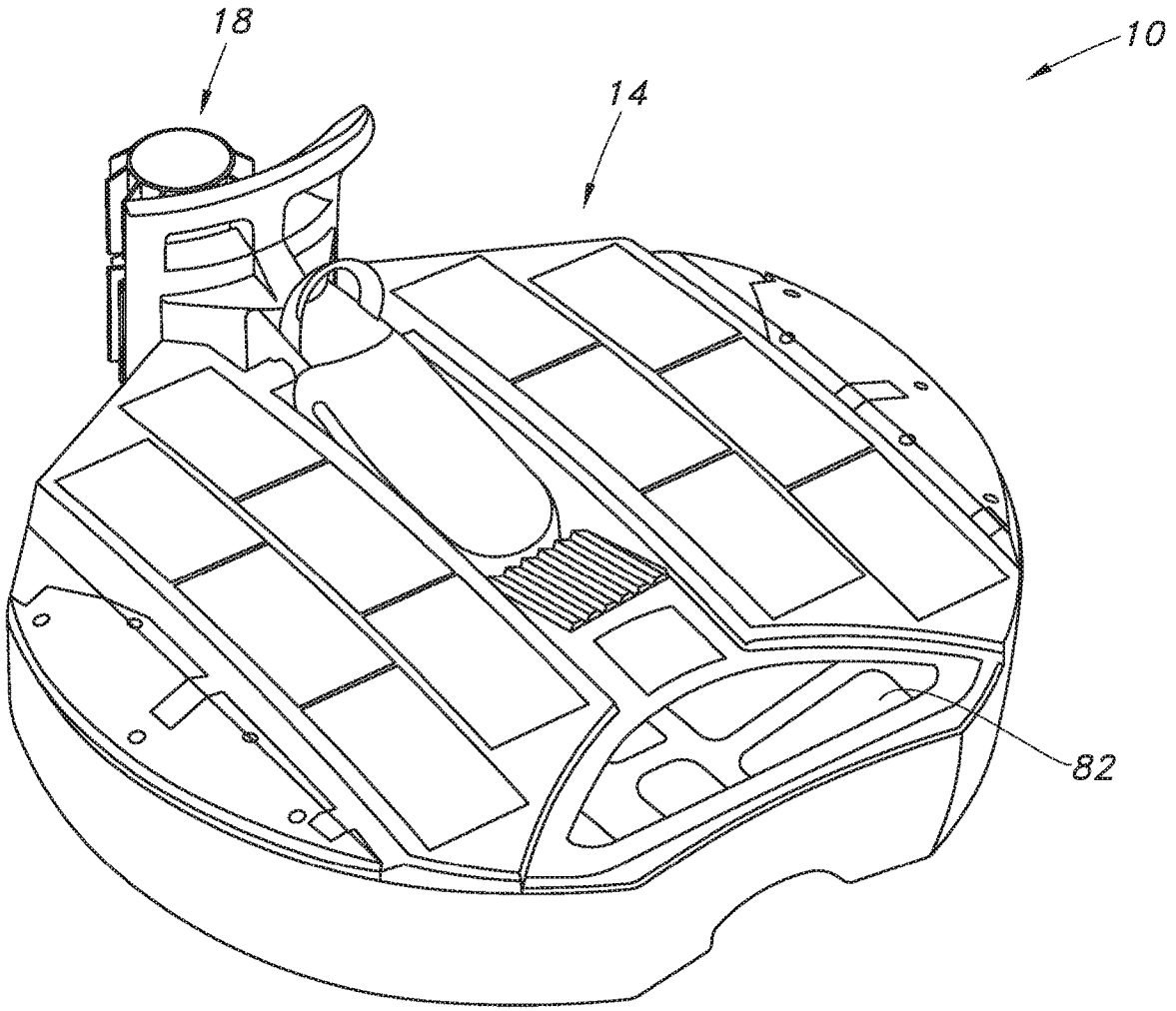
FIG. 2 is another perspective view of the device of FIG. 1.

FIGS. 1-8 illustrate all or portions of an exemplary device 10 consistent with the present invention. Device 10 may comprise body 14 and at least one brush or scrubber 18. Device 10 may also include floats as needed and be weighted and balanced so as to be buoyant in water and thus float on the water surface within a pool or spa.

As shown nominally upright in FIGS. 1-8, body 14 may define upper portion 22 as well as front region 26, side regions 30 and 34, and rear region 38. Body 14 additionally may include lower portion 42 (see, e.g., FIG. 8). Solar panels 46 are illustrated as being present on covers 48A-B of upper portion 22, although such panels 46 are not mandatorily included as part of device 10.

Two scrubbers 18 are depicted in front region 26 of body 14, which may sweep back from the scrubbers 18 at angles of approximately 45°. In a nominally principal direction of travel (see arrow A) of device 10, therefore, scrubbers 18 effectively form a leading portion of the body 14. Hence, scrubbers 18 normally will make initial contact with any sidewall of a pool or spa. More or fewer than two scrubbers 18 may, of course, be deployed as appropriate or desired.

Each scrubber 18 may comprise blades 50. In the versions of scrubbers 18 illustrated in FIGS. 1-8, blades 50 are oriented vertically (or generally so) and extend radially outward from outer perimeter 54. Each scrubber 18 is connected to and configured to rotate about generally vertically-oriented shaft 58, which in turn may be driven by a motor such as first electric motor 62. Accordingly, shaft 58—and the axis about which scrubber 18 rotates—are positioned approximately normal to the surface of the water on which device 10 floats. In some versions of the invention shaft 58 rotates counterclockwise (when viewed from above), although it alternatively may rotate in the opposite direction. Presently preferred is that first electric motor 62 be bidirectional, allowing shaft 58 to rotate either counterclockwise or clockwise.

Figure 5:
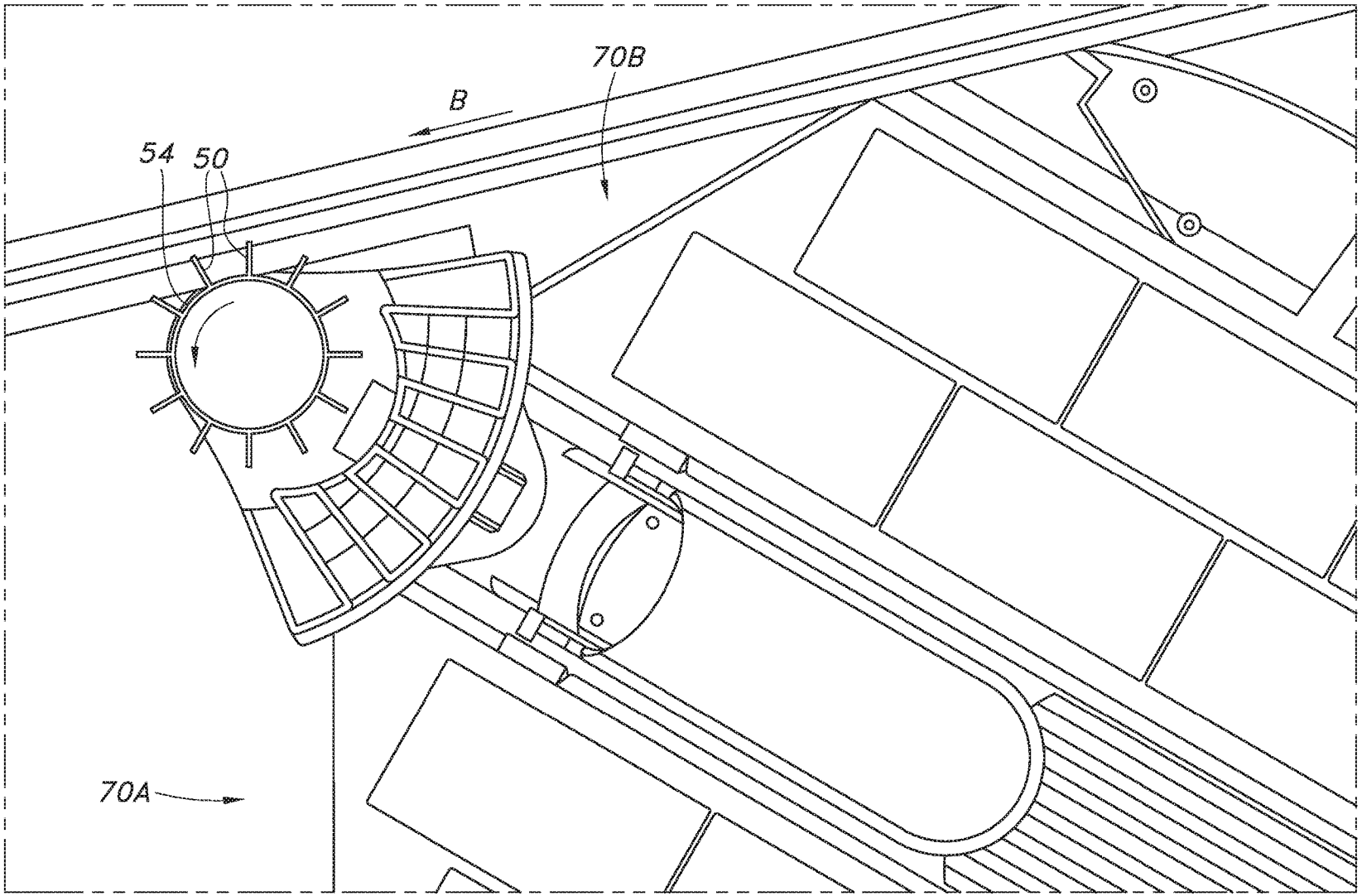
FIG. 5 is a top view of the device of FIG. 1 floating in a pool and contacting a wall of the pool.

Blades 50 preferably are not rigid, but rather are formed of a plastic material so as to flex when contacting a pool wall, hence making frictional contact with the wall so as to scrub debris therefrom without unduly scratching or marking the wall. Although twelve such blades 50 are illustrated in FIG. 5 as protruding from perimeter 54, persons skilled in the art will recognize that more or fewer blades 50 may be used instead. Moreover, because scrubbers 18 may be centrally located across the width of body 14, they may effectively function as a rudder so as to guide movement of device 10.

Additionally illustrated in FIGS. 1-8 is handle 66. Handle 66 may be located in front region 26 and, like scrubbers 18, advantageously may be centrally located across the width of body 14. Only one hand is needed to grasp handle 66; should someone do so from above in order to extract device 10 from a pool or spa, device 10 often will assume an almost-vertical orientation with front region 26 above rear region 38. This orientation may be beneficial, causing water within device 10 to exit rear region 38 while preventing debris from escaping a filtration means within body 14.

Figure 3:
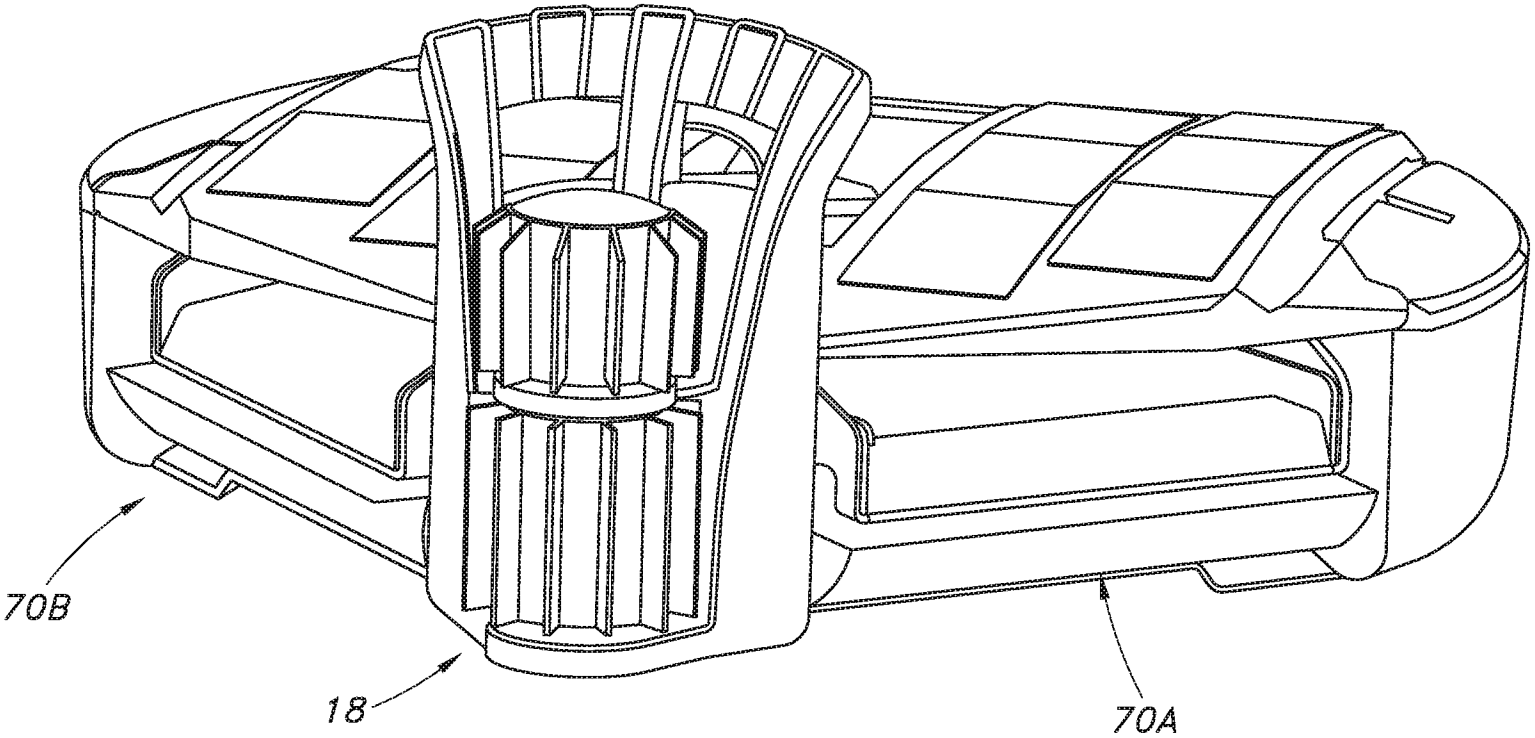
FIG. 3 is another perspective view of the device of FIG. 1.

Well illustrated in FIG. 3 is that front region 26 of body 14 may include filtration inlets 70A and 70B. Inlets 70A and 70B may be positioned to either side of scrubbers 18 and adjacent the water surface of the pool. Such inlets 70A-B allow debris-laden water to enter body 14 for filtering, causing device 10 to operate as a skimmer as well as a scrubber.

Figure 4:
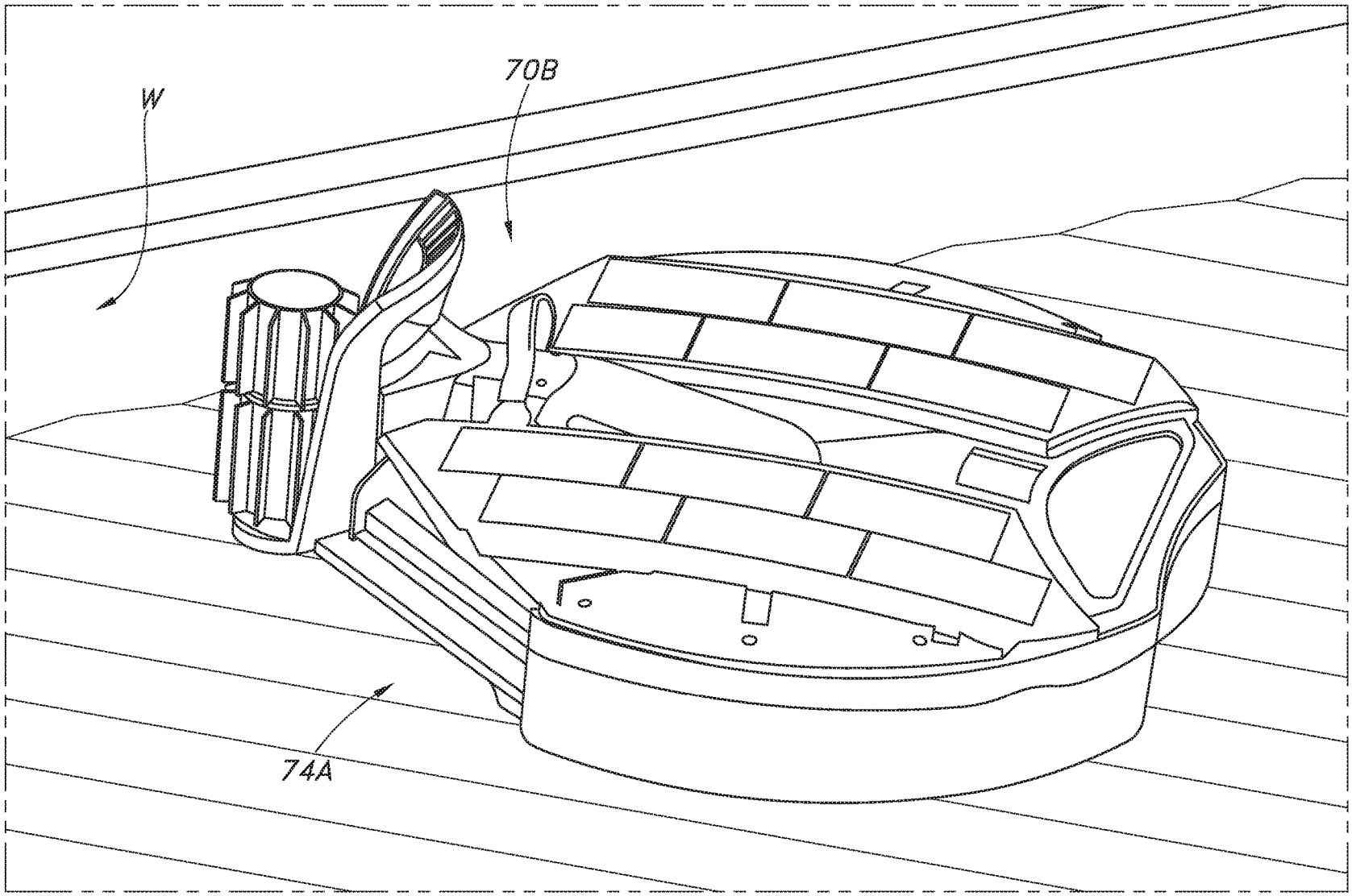
FIG. 4 is a perspective view of the device of FIG. 1 shown as floating in a pool and approaching a wall of the pool.

Although two filtration inlets 70A-B are depicted in, e.g., FIG. 3, more or fewer such inlets may be utilized. Beneficially, however, the dual inlets 70A-B and their positioning to the sides of, and swept back from, scrubbers 18 facilitate capture of debris as device 10 moves along a pool wall. In particular, as device 10 approaches a pool wall, one of the filtration inlets 70A or 70B will be closer to the wall than the other so as to encounter scrubbed debris promptly after the debris has been scrubbed from the wall. FIGS. 4-5 depict this result: FIG. 4 shows device 10 approaching wall W at an angle such that inlet 70B is closer to the wall W than is inlet 70A. The counterclockwise rotation of blades 50 causes device 10 to travel generally linearly along wall W in the direction of arrow B. By contrast, if device 10 were to approach wall W at a similar angle but with blades 50 rotating clockwise, after contacting the wall W, device 10 would turn and begin travelling generally linearly along the wall W in a direction opposite arrow B.

Figure 6:
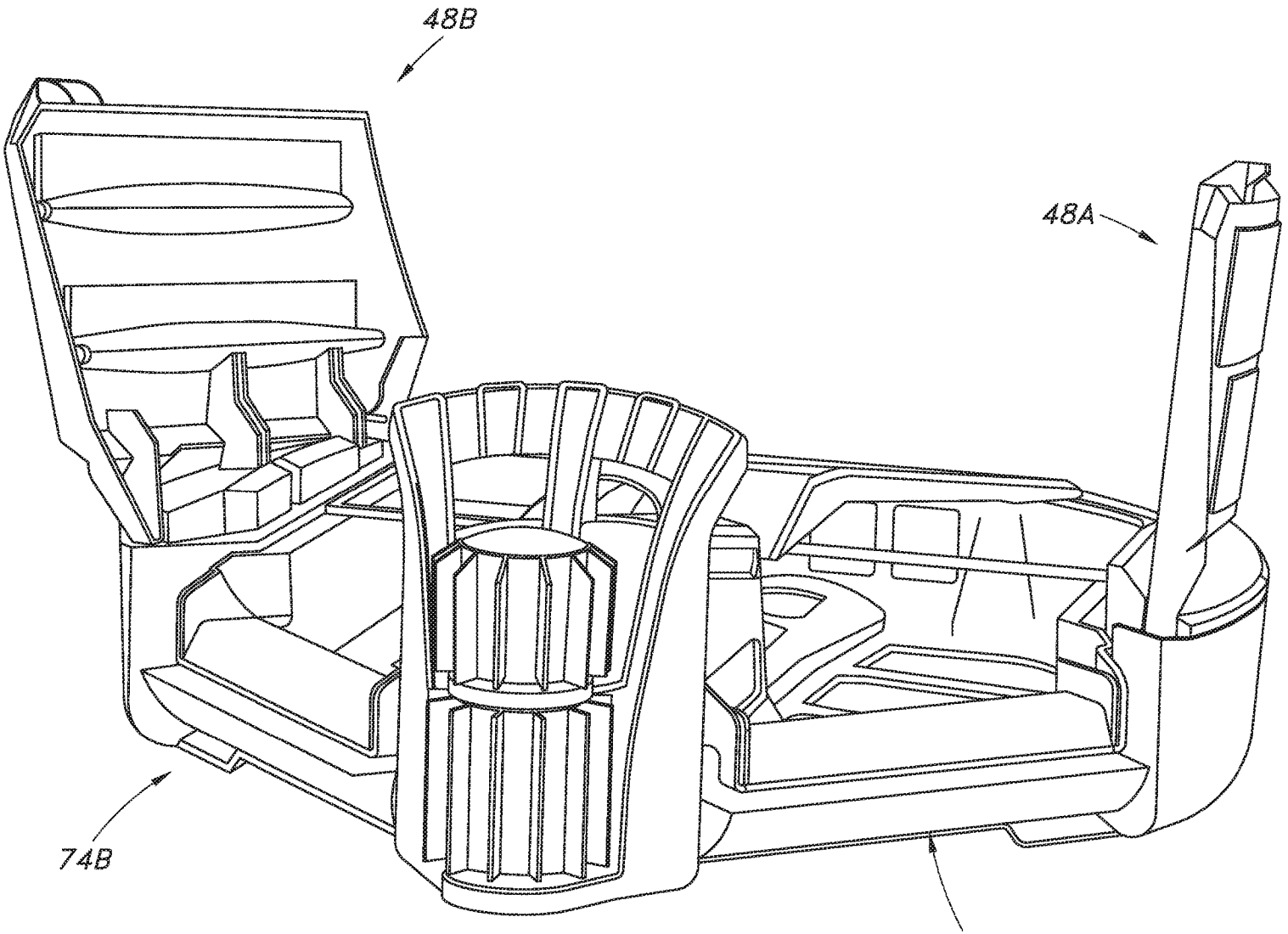
FIG. 6 is a perspective view of the device of FIG. 1 illustrating an access to a debris filtration area of the device.

Further illustrated in, e.g., FIG. 6 are weirs 74A-B, each associated with a respective filtration inlet 70A-B. Weirs 74A-B need not necessarily be included as part of body 14. Nevertheless, if present, weirs 74A-B may help regulate flow of debris-laden water into inlets 70A-B.

Figure 7:
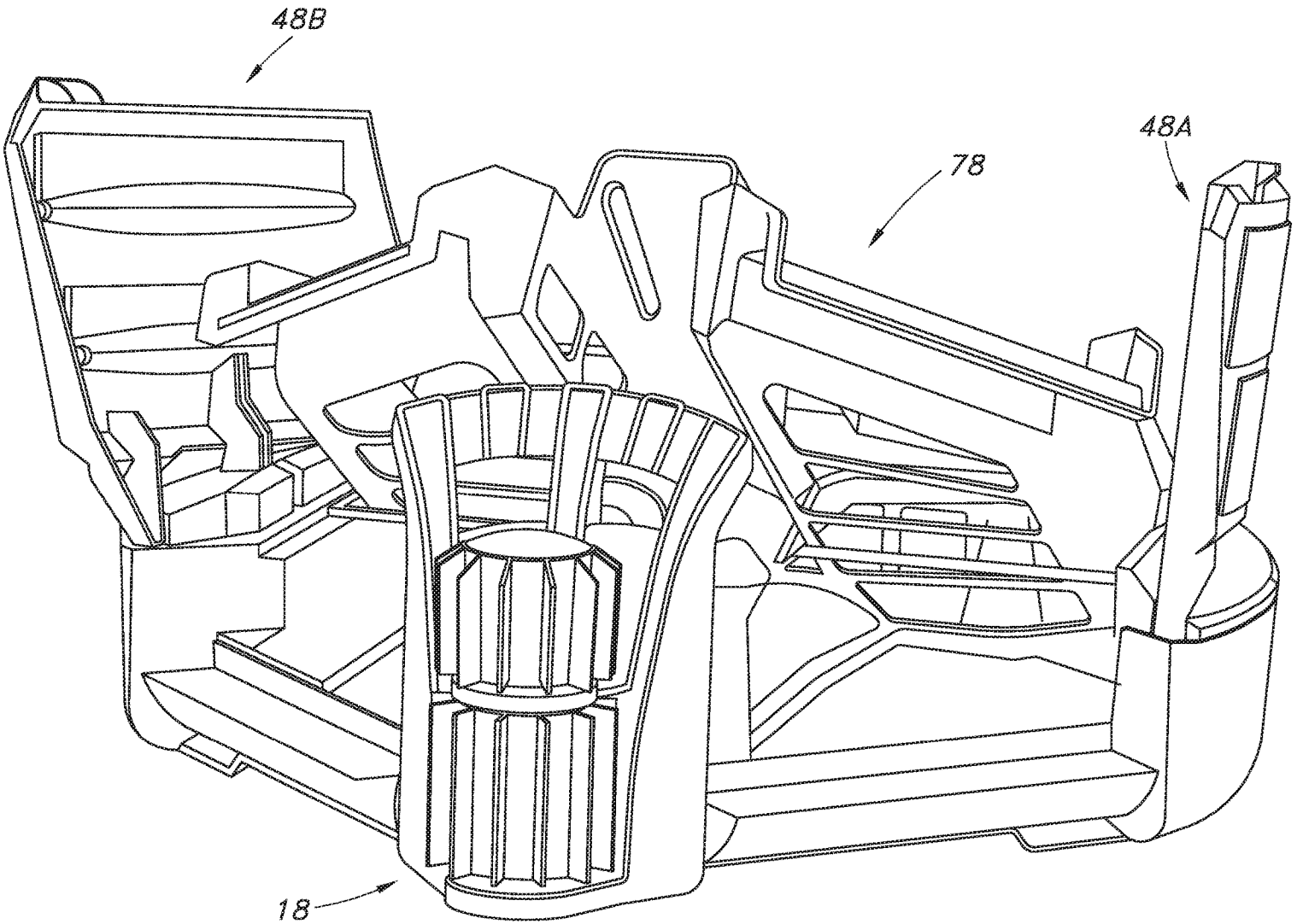
FIG. 7 is another perspective view of the device of FIG. 1 illustrating removal of a debris tray of the device.

FIG. 7 illustrates portions of filtration tray 78 that may be present within body 14. Not shown are mesh panels, a bag, or other understood structure that may trap particles while allowing water to pass through tray 78 for return to the pool. In general, water will enter device 10 through inlets 70A-B, have entrained debris filtered in connection with tray 78, and then exit device 10 back into the pool. Filtered debris may be viewed through window 82 existing in rear region 38 of body 14. Window 82 is, however, optional, and if present may be located elsewhere in or on body 14.

Advantageous is that tray 78 be accessible easily. In some versions of the invention, each of covers 48A and 48B is hinged or otherwise connected to a corresponding side region 30 and 34 of body 14 so as to pivot upward therefrom. This upward pivoting is depicted in FIGS. 6-7, exposing tray 78 for removal (consistent with FIG. 7). Any suitable latches, connectors, or other structure or equipment, or friction or interference fits, may be used to retain tray 78 in position within body 14 yet allow movement of covers 48A-B and removal of the tray 78 from the body 14.

Figure 8:
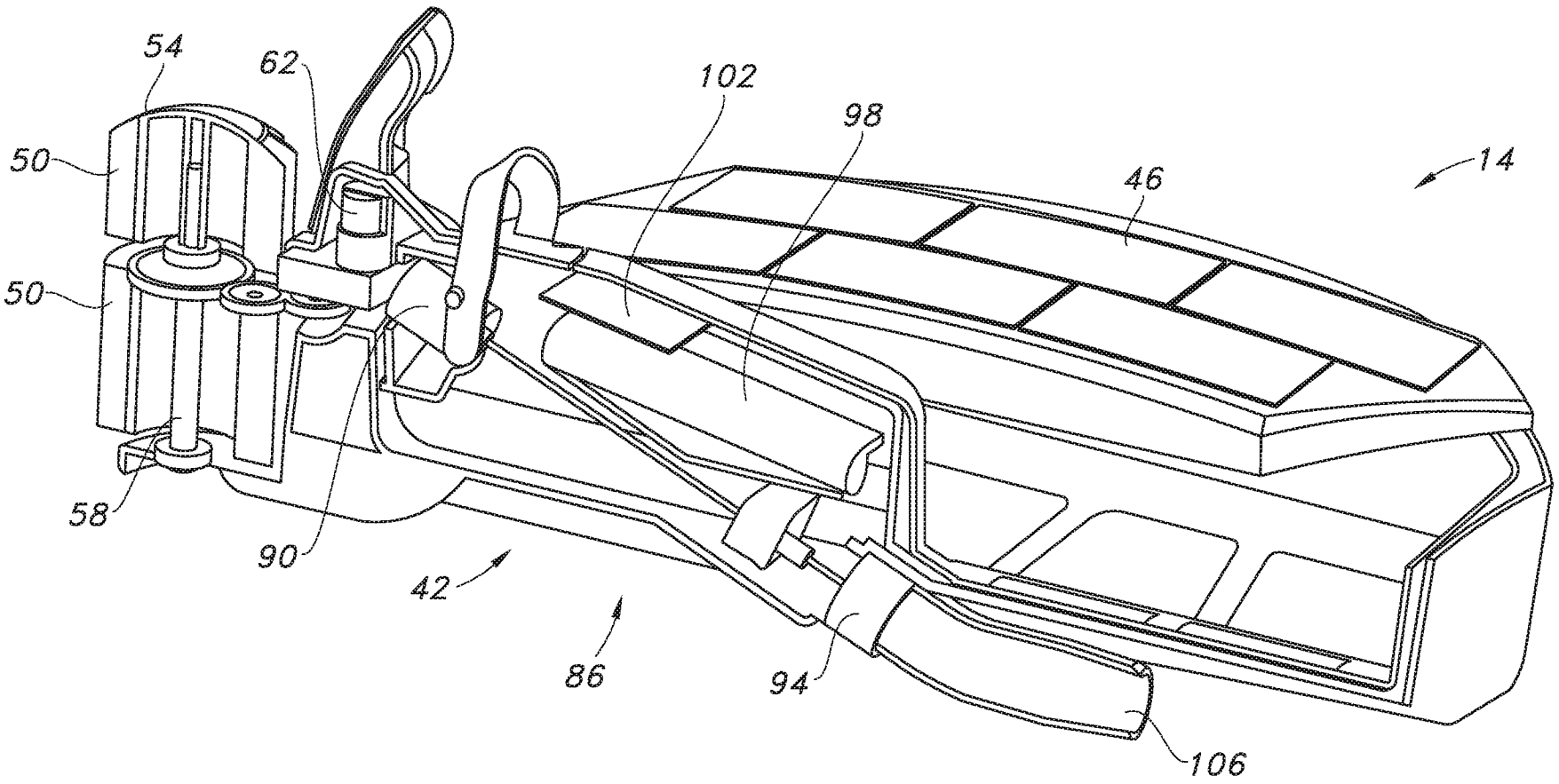
FIG. 8 is a longitudinal cross-sectional view of the device of FIG. 1.
Figure 9:
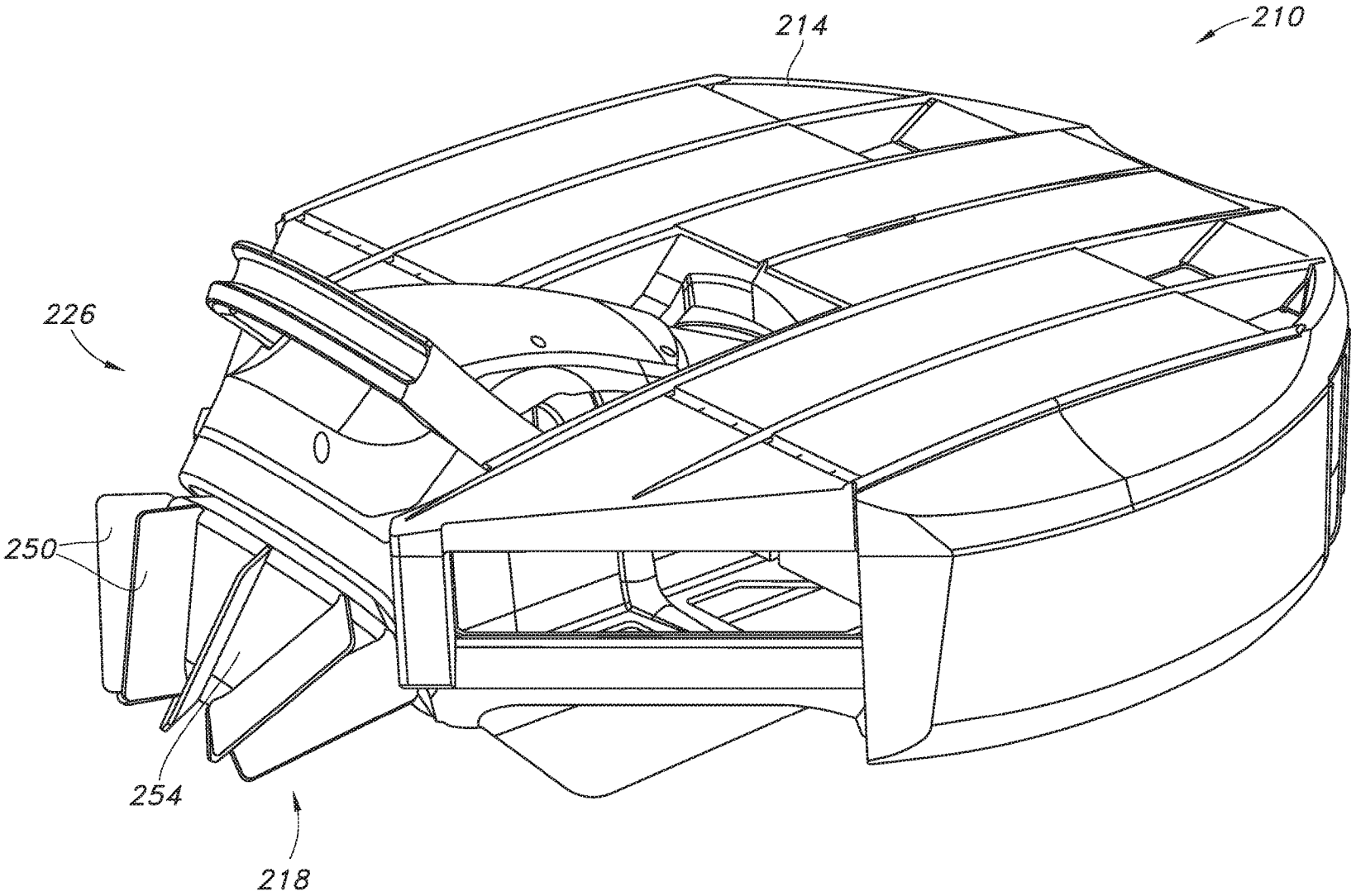
FIG. 9 is a perspective view of an alternate device of the present invention.
Figure 10:
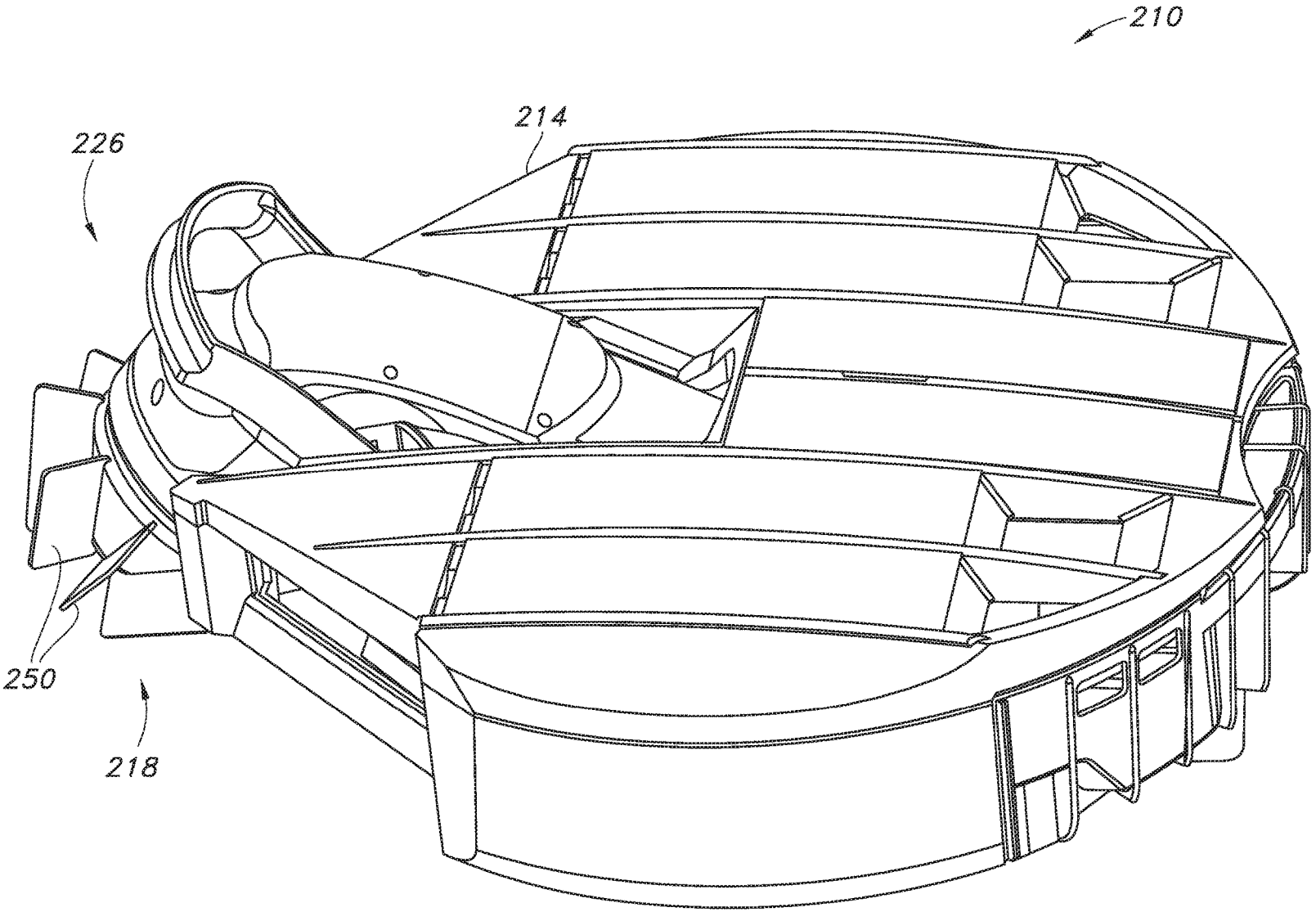
FIG. 10 is another perspective view of the device of FIG. 9.
Figure 11:
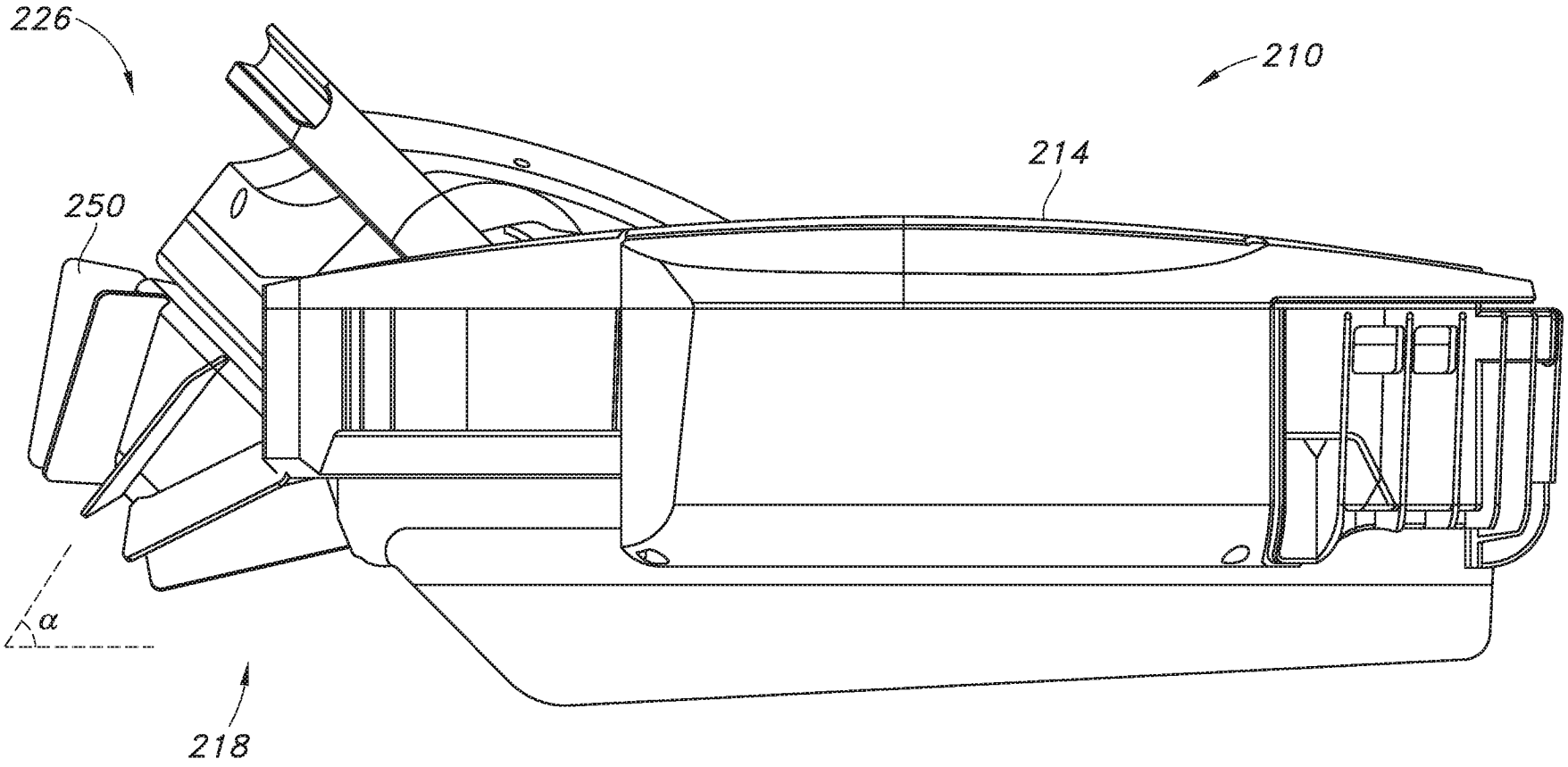
FIG. 11 is a side elevational view of the device of FIG. 9.
Figure 12:
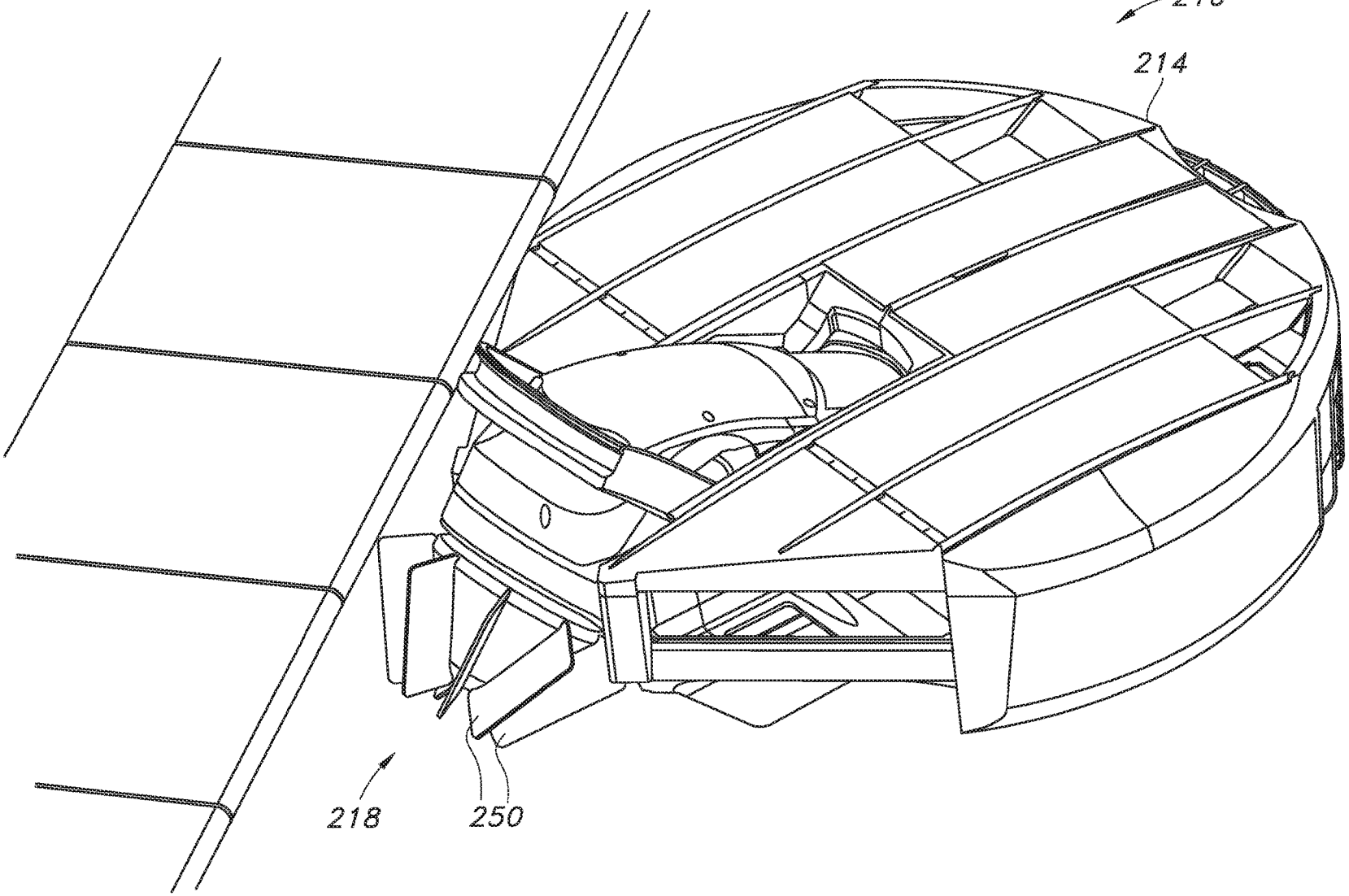
FIGS. 12-14 are perspective views of the device of FIG. 9 shown as floating in a pool approaching a wall of the pool.
Figure 13:
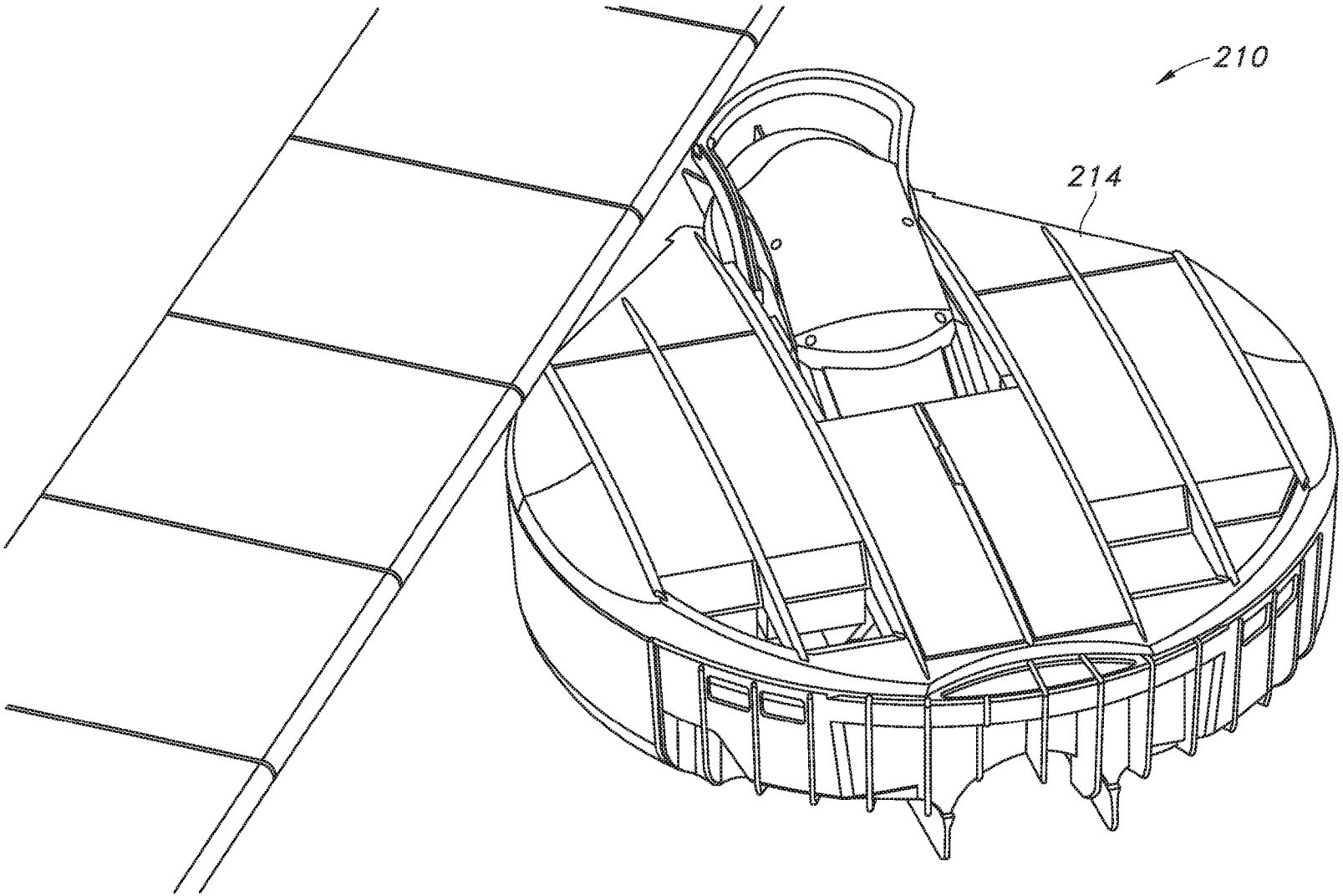
Figure 14:
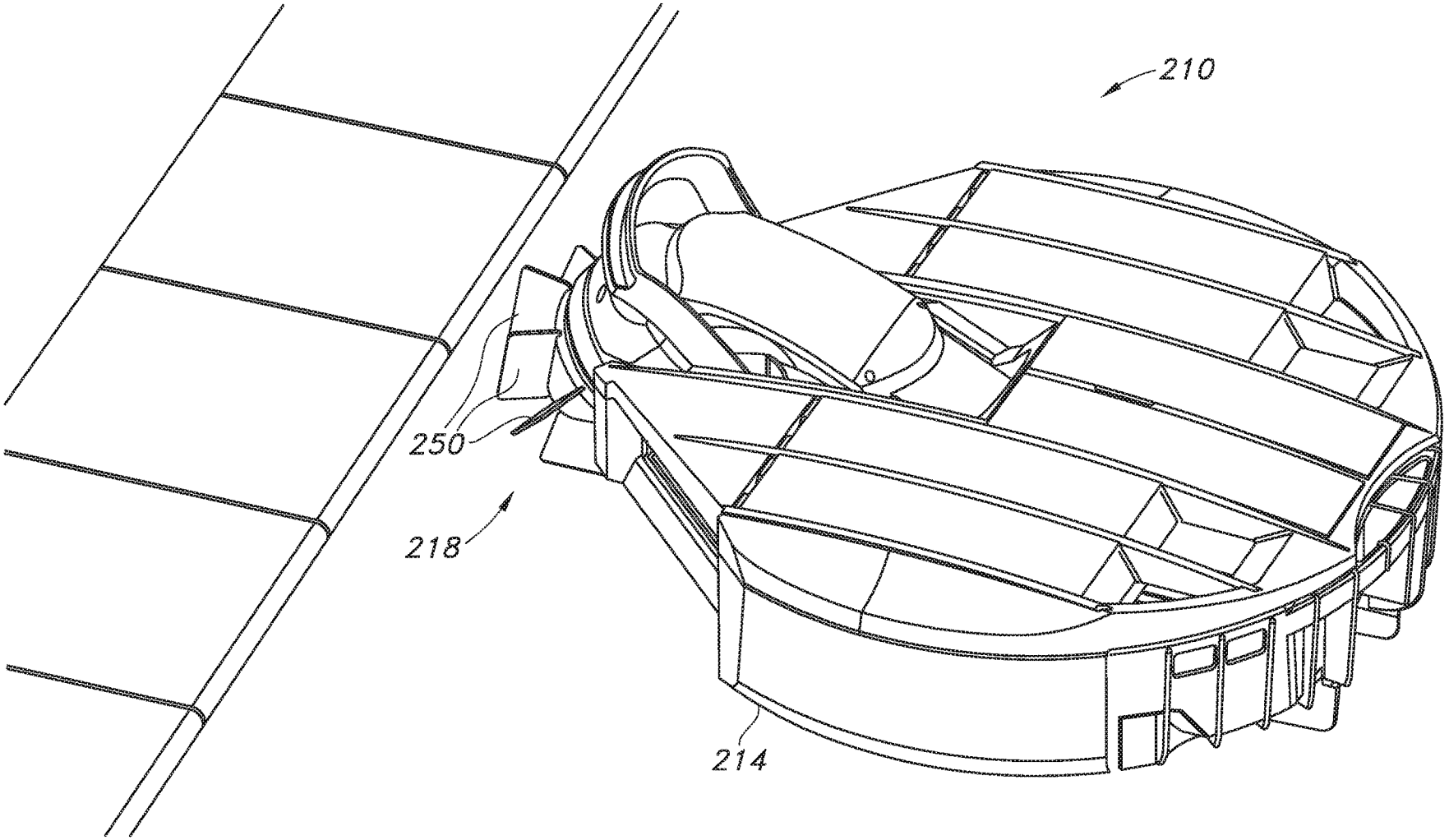

FIG. 8 shows aspects of propulsion system 86 of device 10. System 86 may, for example, include second electric motor 90 and impeller 94. Battery 98 and electronics 102 (shown on a printed circuit board [PCB]) may, if desired, also constitute part of system 86. Battery 98 and electronics 102 also may power and control operation of first electric motor 62.

To effect movement of device 10 in the direction of arrow A, battery 98 powers second electric motor 90. Motor 90 turns impeller 94, forcing water to exit body 14 via exit 106. Acting as a thrust jet, the water exits body 14 in a direction opposite arrow A, propelling device 10 in the direction of arrow A.

By utilizing both scrubbers 18 and propulsion system 86, device 10 is capable of four types of movement:

1. Crawling along a wall at a general 45° tangency, the rotation direction of the scrubbers determining the direction of the crawl (thrust jet on, scrubbers on);
2. Rotating around the general center of device 10 either clockwise or counterclockwise (thrust jet off, scrubbers on);
3. Straight line travel across the pool (thrust jet on, scrubbers off); and
4. In an arc while travelling across the pool (thrust jet on, scrubbers on until steered in a desired direction).

Programming electronics 102 with predetermined combinations and durations of these types of movements enables random covering and scrubbing of the pool surfaces and waterline.

Solar panels 46 conceivably may directly power either or both of motors 62 and 90. Alternatively, solar panels 46 may be used to recharge battery 98. Yet alternatively, battery 98 may be recharged through electrical mains (or in some other manner) or omitted from device 10. Likewise, solar panels 46 may be omitted from device 10. If both solar panels 46 and battery 98 are not present in device 10, motors 62 and 90 may be powered directly through electrical mains (or in some other manner), although powering device 10 by electrical mains may require use of an electrical cord in the swimming pool, which is presently not preferred.

Further conceivable is that either or both of motors 62 and 90 are hydraulic, rather than electric, devices. These devices, however, might require attachment of a hose to device 10 so as to supply the needed fluid. Again, presently preferred is that device 10 be both self-propelled and self-contained, so that no external cord or hose would be needed. Some embodiments of device 10 may include a water sensor configured to alert electronics 102 that the device 10 has been removed from pool water, which in turn may cease operation of motors 62 and 90. Other embodiments may include a mechanism to splash, mist, spray, or otherwise force water against the sidewalls to facilitate their scrubbing.

Exemplary concepts or combinations of features of the invention may include:

A. A floating device configured to actively brush or scrub a wall.

B. A device configured to travel on a surface of water within a pool and actively brush or scrub a sidewall of the pool at and adjacent the waterline.

C. A device configured to (i) actively brush or scrub a sidewall of a pool at and adjacent the waterline and (ii) filter debris present at the surface of water within the pool.

D. An automatic pool cleaner buoyant in water and comprising (i) a body comprising at least one water inlet and at least one water exit, (ii) a motor, (iii) at least one scrubber driven by the motor and configured to rotate about a generally vertical axis nominally perpendicular to a surface of water along which the cleaner travels (or about an axis oriented otherwise), (iv) means, positioned at least partially within the body, for filtering debris from water having passed through the water inlet, and (v) means for propelling the body along the surface of the water.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

FIGS. 9-14 illustrate all or portions of an alternate exemplary device 210 of the present invention. As with device 10, device 210 may include body 214 and at least one brush or scrubber 218. Body 214 may include many or all of the features and components of body 14.

Depicted in FIGS. 9-14 is a single scrubber 218 positioned in front region 226 of body 214. Scrubber 218 generally may be shaped as a cone and may comprise blades 250 extending radially outward from its outer perimeter 254. Scrubber 218 is connected to and configured to rotate about a shaft angled relative to the vertical and horizontal directions (i.e. between 0-90° exclusive); in a presently-preferred embodiment of device 210 consistent with that shown in FIGS. 9-14, the shaft is angled approximately 30° (see FIG. 11, angle $\alpha$) from the vertical direction.

Angling the axis of rotation of scrubber 218 away from the vertical direction aids removal of dried debris stuck firmly to pool walls immediately above the waterline of the pool. In particular, the angling causes portions of blades 250 to alternate between underwater and above-water positions, lifting water onto the wall as they rotate. This water hydrates the dried debris, facilitating its being dislodged from the wall by scrubber 218.

Like scrubbers 18, scrubber 218 additionally drives body 214 along the wall of the pool. By reversing its rotation direction, moreover, scrubber 218 may turn body 214 around to move oppositely along the wall. The angling and conical shape of scrubber 218 is well suited for this purpose too. Stated differently, the cone of scrubber 218 lifts water onto the pool wall by dipping blades 250 in the water on the underside of the cone, while driving front region 226 of body 214 along the wall by "rolling" over that surface.

The conical shape of scrubber 218 supplies additional benefits as well. Clockwise rotation of scrubber 218 turns the entire floating skimmer device 210 to the right. This is so because blades 250 are fully submerged under the cone and moving largely from right to left, "paddling" the nose of front region 226 to the right, whereas on the upper side those blades 250 are moving in air—with resultant little force. This gives device 210 the ability to turn left and right in free water, depending on its rotating direction, but also helps drive scrubber 218 to the wall when moving along the wall as it is also constantly turning into the wall.

Rotating scrubber 218 also results in a backing-up force thereby enabling the reversing of device 210. The force is not large, and can easily be overcome by the thrust motor driving forward in normal use. But by switching the thrust motor off, the force can prove useful to back device 210 out of corners or trapped situations. The force occurs because the cone of scrubber 218 spins water radially outward, mostly perpendicular with the surface of the cone, resulting in a small axial thrust in the direction of the large end of the cone. True is that at the same time it also turns front region 226 of body 214 left or right, but this can be overcome by alternating rotation direction of scrubber 218 periodically (e.g. every five seconds) to obtain a mostly straight reversing motion.

The entire contents of the Altschul, Distinti, and Maaske patents and the Riley application are incorporated herein by this reference. Further, although applicant has described devices and techniques for use principally with swimming pools, persons skilled in the relevant field will recognize that the present invention may be employed in connection with other objects and in other manners. Finally, references to "pools" and "swimming pools" herein may also refer to spas or other water containing vessels used for recreation or therapy and for which cleaning is needed or desired.

What is claimed is:

1. A floating device:

a. configured for travel on a generally horizontal surface of water within a swimming pool; and b. comprising a rotatable scrubber configured to actively brush or scrub a wall of the swimming pool, with the rotatable scrubber including:

i. an outer perimeter of generally conical shape; and ii. a plurality of blades extending from the outer perimeter.

2. A floating device according to claim 1 in which at least one of the plurality of blades extends radially from the outer perimeter.

3. A floating device according to claim 2 further comprising a motor for driving rotation of the rotatable scrubber.

4. A floating device according to claim 2 in which the rotatable scrubber rotates about an axis forming an angle of less than ninety degrees with the generally horizontal surface of water.

5. A floating device according to claim 3 in which the motor is a bidirectional electric motor.

6. An automatic pool cleaner buoyant in water and comprising (a) a body comprising at least one water inlet and at least one water exit, (b) a motor, (c) at least one scrubber driven by the motor and configured to rotate about an axis, and (d) means, positioned at least partially within the body, for filtering debris from water having passed through the water inlet; and in which the at least one scrubber includes an outer perimeter of generally conical shape and a plurality of blades extending from the outer perimeter.

7. An automatic pool cleaner according to claim 6 in which at least one of the plurality of blades extends radially from the outer perimeter.

8. An automatic pool cleaner according to claim 6 in which the motor is a bidirectional electric motor.

9. An automatic pool cleaner according to claim 6 further comprising means for propelling the body along a surface of the water.

10. An automatic pool cleaner according to claim 9 in which the propelling means comprises a thrust motor.

11. An automatic pool cleaner according to claim 6 in which the body defines a front region, further comprising a handle located in the front region.

12. An automatic pool cleaner according to claim 6 in which the filtering means comprises a filtration tray.

13. A floating device:

a. configured for travel on a generally horizontal surface of water within a swimming pool; and b. comprising a rotatable scrubber configured to actively brush or scrub a wall of the swimming pool, with the rotatable scrubber:

i. having a generally conical shape; and ii. configured to rotate about a shaft angled relative to the generally horizontal surface between 0-90° exclusive.

14. A floating device according to claim 13 further comprising a motor configured to drive the shaft.

15. A floating device according to claim 14 further comprising a body comprising at least one water inlet and at least one water exit.

16. A floating device according to claim 15 further comprising means, positioned at least partially within the body, for filtering debris from water having passed through the water inlet.

17. A floating device according to claim 16 in which the body defines an upper portion (a) positioned above the generally horizontal surface at all times in use and (b) further comprising at least one solar panel.

18. A method of cleaning a swimming pool comprising:

a. introducing into the swimming pool a floating device comprising a body and a rotatable scrubber; and b. causing operation of the floating device so that the rotatable scrubber both (i) actively brushes or scrubs a wall of the swimming pool and (ii) determines a direction of travel of the body along the wall, with rotation of the rotatable scrubber in a first direction determining a first travel direction of the body along the wall and rotation of the rotatable scrubber in a second direction determining a second travel direction of the body along the wall, the first direction being opposite the second direction and the first travel direction being opposite the second travel direction.

19. A method according to claim 18 in which the rotatable scrubber (a) is shaped generally as a cone from which blades extend and (b) lifts water of the swimming pool onto the wall by dipping the blades into water of the swimming pool on the underside of the cone.

* * * * *